US006591920B1

(12) United States Patent
Foppe

(10) Patent No.: US 6,591,920 B1
(45) Date of Patent: Jul. 15, 2003

(54) MOULTEN BATH DRILLING METHOD

(76) Inventor: Werner Foppe, Siegstrasse 12, D-52511, Geilenkirchen (DE)

( * ) Notice: Subject to any disclaimer, the term of this patent is extended or adjusted under 35 U.S.C. 154(b) by 0 days.

(21) Appl. No.: 09/914,485

(22) PCT Filed: Feb. 9, 2000

(86) PCT No.: PCT/EP00/01015

§ 371 (c)(1),
(2), (4) Date: Aug. 27, 2001

(87) PCT Pub. No.: WO00/53883

PCT Pub. Date: Sep. 14, 2000

(30) Foreign Application Priority Data

Mar. 5, 1999 (DE) ..... 199 09 836

(51) Int. Cl.[7] ..... E21B 7/15; E21C 37/16

(52) U.S. Cl. ..... 175/67; 175/16; 175/17; 299/14

(58) Field of Search ..... 175/65, 67, 11, 175/12, 16, 17; 299/14

(56) References Cited

U.S. PATENT DOCUMENTS 3,357,505 A 12/1967 Armstrong et al.
3,396,806 A * 8/1968 Benson ..... 376/273
3,679,007 A * 7/1972 O'Hare ..... 175/16
3,693,731 A 9/1972 Armstrong et al.
5,107,936 A 4/1992 Foppe
5,168,940 A 12/1992 Foppe
5,479,994 A * 1/1996 Soloviev et al. ..... 175/11
5,573,307 A * 11/1996 Wilkinson et al. ..... 299/14
5,735,355 A 4/1998 Bussod et al.

FOREIGN PATENT DOCUMENTS

DE 25 54 101 C2 6/1977
DE 19501437 A1 9/1996

OTHER PUBLICATIONS

Handbook of Chemistry and Physics, p. F–19, 56th Edition, 1975–1976.

* cited by examiner

*Primary Examiner*—David Bagnell
*Assistant Examiner*—Jennifer H. Gay
(74) *Attorney, Agent, or Firm*—Herbert Dubno

(57) ABSTRACT

A fusion drilling process and device for the placement of dimensionally accurate borings, particularly those of large diameter, in rock, in which the waste melt is pressed into the surrounding rock, which is cracked due to the effect of temperature and pressure, and in which a borehole lining is produced by solidifying melting during boring, with a melt containing metal supplied through pipeline elements as a boring medium to the base of the borehole to be removed through melting. For this purpose a melt made of magnetic metal is preferably used.

29 Claims, 1 Drawing Sheet

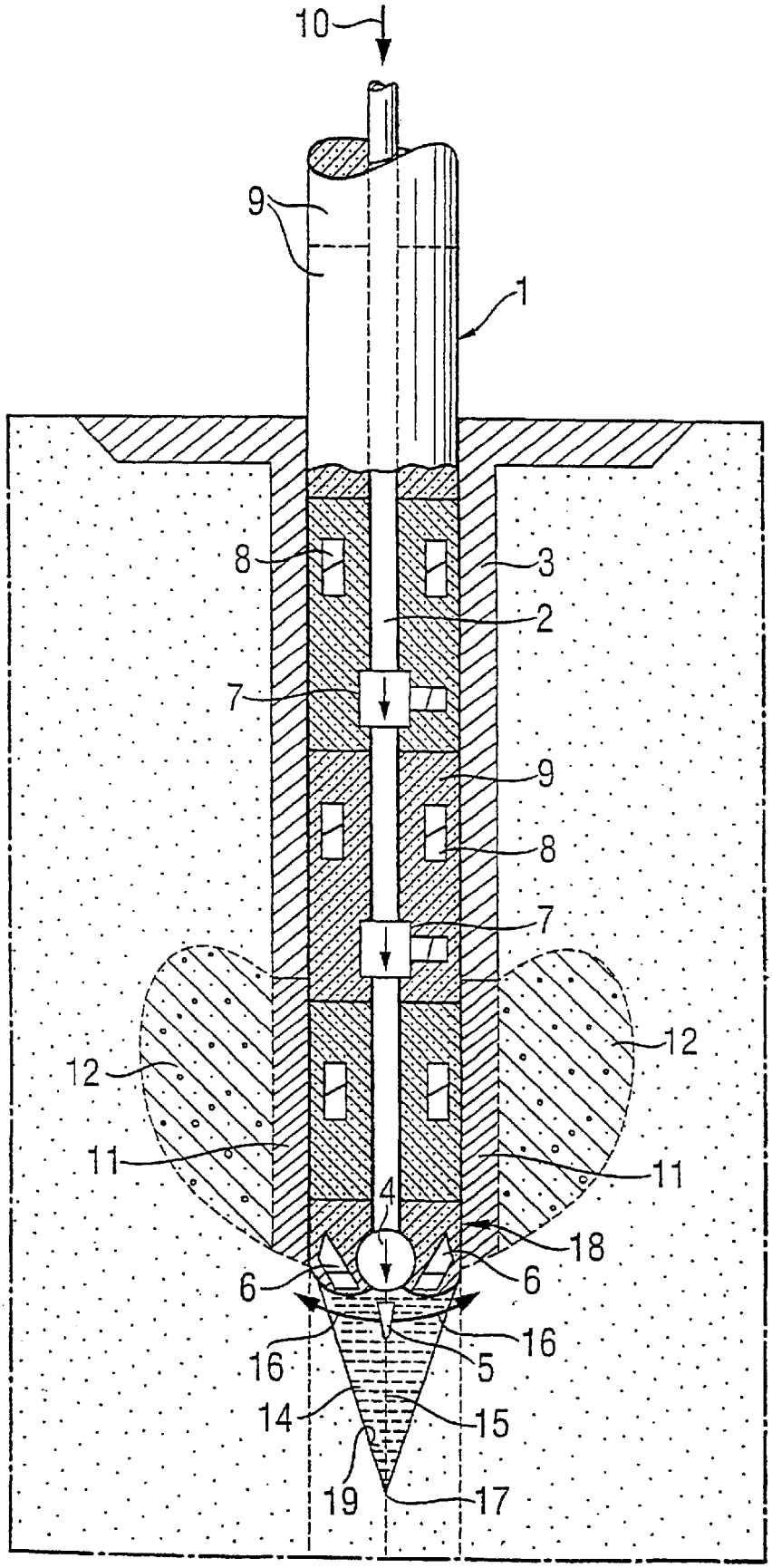
10
9
1
8
3
2
7
9
8
7
12
12
11
11
4
18
6
6
16
16
5
14
15
19
17

MOULTEN BATH DRILLING METHOD

CROSS REFERENCE TO RELATED APPLICATIONS

This application is a national stage of PCT/EP00/01015 filed Feb. 9, 2000 and based upon a German national application 199 09 836.0 of Mar. 5, 1999 under the International Convention.

FIELD OF THE INVENTION

The present invention relates to a fusion drilling process for the placement of dimensionally accurate borings, particularly those of large diameter, in rock, in which the waste melt is pressed into the surrounding rock, which is cracked—due to the effects of temperature and pressure, and in which a borehole lining is produced during boring by solidifying melt.

BACKGROUND OF THE INVENTION

The placement of borings in rock by means of melting the rock to be removed is generally known. Thus, for example, U.S. Pat. No. 3,357,505 discloses a boring head with which the melting of rock is performed.

This known boring head, which consists of a metal resistant to high temperatures, such as molybdenum or tungsten, is heated by means of heating elements to a temperature above the melting temperature (1000–2000° C.) of the rock and pressed at high pressure by means of costly extendable propulsion rods into the rock, which then melts.

The problems associated with transporting away the waste rock melt occurring in the boring process are solved in this case in that the rock melt enters into an opening of the boring head and is then conveyed to the surface within a conductor pipe by a rapid gas stream.

In spite of the resistant material, the boring head is subject to great wear due to the corrosive effects of the molten rock, so that it occasionally has to be replaced.

Furthermore, solving the problems associated with the waste by subjecting the melt to a high pressure, in addition to the naturally prevailing extremely high temperature gradients between the rock melt and the surrounding solid rock at the boring head, in order to cause the formation of cracks and splits of the surrounding solid rock into which the waste rock melt can be pressed through temperature and pressure stress is also known. It is thus no longer necessary to convey the waste material to the surface due to this process.

Also known is the pressing of the rock melt around the boring head during the production of fusion drilling borings, so that the melt solidifies above and around the fusion drilling head, particularly due to additional cooling measures which are provided, and the borehole is lined with a uniform glassy melt layer.

A device of this type, in which the rock is melted by an H2/O2 flame, is known from DE 2,554,101.

A fusion drilling device and a process for the operation of the device, which utilizes the pressing of the waste into the surrounding stone and the borehole lining, is known from DE 195 01 437 Al. The device described here is used in salt galleries and uses the molten salt itself as the boring medium.

In the known devices, there is a problem in that, due to the melt solidifying above and around the boring device, adhesion occurs between the wall of the boring device and the lining of the borehole, which typically must be overcome through special hydraulic propulsion and lifting facilities in order to bore further.

Correspondingly, a continuous hydraulic pressure must be used when operating with the known process, which makes the boring facility as a whole very costly, because it must be designed for enormous pressures of up to several thousand tons.

A boring device known from U.S. Pat. No. 5,168,940 uses a metal ceramic mixture for the boring head in order to reduce wear and more easily overcome the adhesive forces between the boring head surface and the rock melt.

The known facilities must be equipped with costly supply lines in order to supply the enormous quantities of energy for heating to the boring head over several kilometers of bore depth.

Due to the melting around the boring head, the later lifting of the boring device is also problematic in this case.

OBJECTS OF THE INVENTION

An object of the invention is to provide an energy-saving, universally usable boring process with which extremely deep borings, shafts, and tunnels, both horizontal and vertical, particularly those with large borehole diameters of, for example, more than 1 m, can be made, ready for use, in any rock substrate.

Furthermore, it is an object of the invention to provide a process and a device for performance of this process with which the fusion drilling process can be performed economically and easily without additional cooling measures, without time-consuming drill pipe assembly, without moving components, without changing of the boring head, without waste transport, and without subsequent lining and casing work.

A further object of the invention is to provide special materials for general use in fusion drilling processes.

SUMMARY OF THE INVENTION

These objects are achieved according to the invention by, among other things, supplying, as the boring medium, a melt containing metal through pipeline elements to the base of the borehole, which is to be removed through melting.

According to the invention, to perform the boring process, a heated melt containing metal, which is also understood to mean a pure metal melt, e.g. an iron melt at a pouring temperature of approximately 2000° C., is poured as a low viscosity boring medium into the first pipeline element in the direction of boring, so that the metal melt comes out of the last pipeline element directly over the base of the borehole and melts and removes the rock from the base of the borehole.

The removal of the molten waste rock is hereby promoted in that the rock has a significantly lower density than the metal melt, so that the rock melt automatically floats on the metal melt. The base of the borehole is thus automatically and continuously freed from the molten rock melt.

Due to the high static pressure which results from the metal melt column standing in the pipeline elements, the metal melt coming out of the lowermost pipeline element is guided with the waste material (rock melt), in the process according to the invention, between the outer side of the pipeline elements and the inner wall of the borehole, where they solidify as the boring progresses. Because the boring process is performed without further cooling measures, energy and cost savings of over 50% relative to known fusion drilling processes result.

The solidified melt, which can also be a mixture of melts made of metal and rock, forms a pressure seal between the pipeline element and the inner wall of the borehole, so that, due to the extremely high temperature gradients in the rock and the pressure generated, splitting of the rock material occurs automatically, whereby above all the lighter waste melt is pressed into the surrounding rock.

The loss of metal melt which results due to the compression and solidification can be compensated at the beginning of the boring at the first pipeline element through addition of metal melt. This addition can be performed continuously or discontinuously, because the volume of the melt column resting on the base of the borehole acts as a reservoir.

In this way, it is possible according to the invention to produce a dimensionally stable lined borehole, particularly lined with cast metal, which can have a large diameter, e.g. of more than 1 m, and essentially any desired profile, with this borehole able to be supplied for its intended use without any further post-processing, due to the automatic cast metal lining. The boring can hereby be performed not only vertically, but also horizontally or at other angles to the surface of the earth, so that borings for greatly differing intended uses such as, e.g., geothermal power stations, supply lines, or tunnels can be produced.

This means that, in the metal melt boring process according to the invention, in one single work cycle a borehole is melted, the borehole melt is pressed into the surrounding rock, and a compressed, stable borehole lining is made from the cooled rock melt which is simultaneously also lined with a seamless metal wall.

The process according to the invention thus advantageously allows the possibility of sinking metal-lined boreholes of the dimensions mentioned even to depths of over 10 kilometers in one work cycle, without having to remove the borehole melt or having to supply coolant, and with work able to be done at the boring target at temperatures of over 3000° C. , rock pressures of over 1,000 bar, melt cutting forces of up to 10,000 bar or more, and a pipeline element weight of over 10,000 tons, which the current mechanical boring technology does not allow.

It is particularly advantageous if the melt used as the boring medium contains magnetic metals, such as iron, cobalt, or nickel, and/or completely consists of these metals or metal alloys. Various non-magnetic metal melts, such as copper, can also be used in the process according to the invention, however, iron melt, for example, particularly suggests itself in this case, because the costs of this type of melt are low, iron is readily available, and it has a high vaporization point of approximately 3000° C. at atmospheric pressure.

The use of a magnetic melt results, as will be explained later, in the possibility of electromagnetically manipulating and/or controlling the entire boring device.

Because, even at atmospheric pressure, an overheated iron melt at approximately 3000° C. can be worked with in the fusion drilling process, the highest material demands are placed on the pipeline elements through which the iron melt is supplied to the base of the borehole.

In general, it is proposed that greatly varying boring devices for the production of fusion drilling borings in rock, with which the rock to be removed can be melted and by means of which a borehole lining made of solidified melt can be produced through the melt arising in the melting process and/or the melt supplied into the borehole, be advantageously implemented in such a way that the surfaces of the boring device in contact with the molten or solidified melt mass consist of a material resistant to high temperatures.

The boring devices may be not only the device according to the invention, but all fusion drilling devices, as they are known, for example, from U.S. Pat. No. 3,357,505, and, in particular, DE 2,554,101.

It should be noted here that the concept of melt should be understood to include not only the pure rock melt arising in typical processes, but also the melt supplied to the borehole according to the process according to the invention described here and/or the mixture of both of these melts which occurs.

Correspondingly, the pipeline elements, which are used to perform the process according to the invention, are preferably implemented in such a way that the surfaces in contact with the molten or solidified melt mass consist of a material resistant to high temperatures.

In a particularly advantageous embodiment, the pipeline elements for performing the process according to the invention are manufactured completely from the preferred material, because in this way composite construction and excessive complexity of the individual components are avoided.

In order to prevent adhesion between the solidified melt and the elements of boring devices, and particularly the pipeline elements of the boring device according to the invention, the material is to be selected so that, for example, its frictional coefficient is smaller than 0.5 and the material has a low surface tension, in order to ensure that no wetting occurs between the material and the melt.

Graphite or metal composite ceramics are, for example, suitable as the material selected.

Graphite can meet all of the required demands as a material for the boring device and particularly for the pipeline elements. Thus, graphite is, for example, a good heat and current conductor parallel to its lamination, but acts as an insulator perpendicular to its lamination. Graphite can therefore be used both for thermal insulation of the metal melt and for current conduction. Furthermore, it has a high strength and slides easily, can be worked like metal, and can be preformed and shaped in its raw state with dimensional accuracy.

Furthermore, a particular advantage of graphite is that it is not moistened by metal or the rock melts, as desired, and is temperature resistant at normal pressure up to approximately 3000° C. in a non-oxidizing atmosphere. In addition, graphite is distinguished in that its strength also increases with increasing temperature, with the tensile strength and compressive strength, respectively, reaching their maximum of approximately 100 and 400 MPa, respectively, at approximately 2500° C.

Because, however, graphite oxidizes in an oxygen atmosphere from approximately 400° C., i.e. burns, the boring process is preferably performed, or at least begun, under an inert gas atmosphere. The inert gas is preferably argon, which, due to its high density, does not leak away from the borehole on its own. As the boring progresses, the graphite elements are no longer under an oxygen atmosphere, so that the inert gas supply can be turned off.

The pipeline elements used for the process should essentially be understood to be individual cylindrical parts, particularly made of graphite, as mentioned, which have a central boring.

The individual cylindrical parts, in which the ratio of the external diameter to the internal diameter is large, particularly larger than 10 to 1, can be connected with one another so that a graphite pipeline can be made which, in the fusion drilling process according to the invention, assumes the functions of fusion drilling head, boring device body, and supply and pressure lines.

It is also advantageous that, due to the metal content according to the invention, the melt can additionally be heated by current, in order to ensure that the melt reaches the base of the borehole in a heated, fluid condition.

In this case, for example, an iron melt, as an electrically conductive fluid, can assume both the function of energy transport to the rock to be melted and the function of current conductor.

The current flow can here be closed at an uppermost pipeline element, i.e. at the beginning of the boring, through the metal melt guided in the pipeline elements, via the metal melt present at the base of the borehole, and back via the external solidified metallic borehole lining. It is also possible to carry the current through the graphite pipeline down to the melt over the base of the borehole.

The current for heating of the metal melt can hereby be coupled directly or inductively into the melt.

As the depth of the bore progresses, it is provided that further pipeline elements, i.e., for example, further graphite cylinders, can be attached to each preceding element.

This results, in the final effect, in a pipeline made of graphite pipe which extends through the entire depth of the bore. Due to the lower density of graphite relative to the metal melt, the graphite pipeline initially floats on the melt and slides toward the depths while supplying metal melt and removing the base of the bore. Then an equilibrium results between the pressure necessary for compressing the melt and the pressure obtaining in the melt due to the weight of the upright graphite pipe and the melt column.

The thickness of the melt cushion under the graphite pipeline is hereby approximately 10 cm. The boring speed is approximately 5 mm per second, whereby it should be noted that the boring according to the invention is performed without changing the boring head, without cooling, and without conveyance of waste.

Changing the boring head is unnecessary in any case because the pipeline elements consisting of graphite can be mechanically identical, so that a possible burning away of the lowest element is not disadvantageous. However, care should be taken here that each lowest pipeline element subject to possibly being burned away does not have any electrical elements surrounding the burning zone whose consumption could lead to destruction or malfunction.

An essential point of the idea according to the invention is that, due to the unusual material properties of graphite, no obstructive adhesion occurs between the solidified cast metal borehole lining and the outer side of the pipeline elements consisting of graphite, so that the graphite pipeline can actually slide into the depths essentially without friction losses and is just as easy to lift out later.

This results due to the low surface tension relative to the melt and the low friction coefficients of graphite, which even become smaller with increasing temperature.

It is further advantageous if the individual pipeline elements have controllable magnetic devices in their particularly thickly implemented walls, through which the pipeline elements can be guided and/or supported like a magnetic glider in the solidified metallic borehole lining, which preferably consists of iron.

In order to ensure that the individual electromagnets can be controlled from outside the borehole, the individual pipeline elements have internal control lines and contact points which correspond to one another, via which the magnetic devices can be supplied with control signals over the entire pipeline.

Through this embodiment, it is possible to realize a traveling magnetic field between the metallic borehole lining and the magnetic devices mentioned, so that the graphite pipeline can be moved up and down like a magnetic glider in the borehole through appropriate.control of the magnetic devices. In particular, this makes it possible to influence the pressure ratios at the base of the borehole and to, in turn, lift the graphite pipeline at the end of the boring procedure.

Thus, in combination with the magnetic borehole lining, tensile, retention, or pressure forces can be exercised on the pipeline elements through electronic control. The weight of the pipeline elements acting in the depths is therefore able to be manipulated, so that the thickness of the melt cushion on which the pipeline elements float is also adjustable.

The later lifting can be made even easier if the completed borehole is flooded for support, particularly with pressurized water, with, in the case of intended fluid mining or energy mining, the lower production region of this type of borehole remaining unlined, and the borehole wall, which is glassed over with molten rock, broken up under the delivery pressure of the water and the fluid or high temperature geothermal water released.

In a further embodiment, it is additionally provided that further controllable magnetic devices, which act as valves for the metal melt to be supplied, are inserted within the wall of the pipeline elements, so that the flow of the metal melt within the pipeline elements can be influenced.

Through this installation of the valves (magnetic valves) according to the invention, it is possible that a portion of the entire metal melt strand standing on the base of the borehole is carried in each pipeline element by closing the magnetic valves, so that the increasing weight of the metal melt strand can be distributed onto several support points, which results in the individual pipeline elements of the graphite pipeline being held in place with the support/guide magnets in the cast-iron lining of the borehole.

It is thus possible to vary the weight of the metal melt column. Thus for example, a predefined amount of metal melt can be supplied to the base of the borehole through the targeted opening of the magnetic valves, or, through simultaneous opening of all magnetic valves, the entire weight of the metal melt strand can have a pulsed action upon the base of the borehole. At a depth of 10,000 m, the pressure of the iron melt column is hereby already over 7,000 bar.

Through pulsed control of the valves, a vibration can be generated in the melt over the base of the borehole, which produces a suction effect, thereby freeing the base of the borehole from molten rock and thus increasing the progress of boring.

The magnetic devices according to the invention for the implementation of support/guide magnets and/or magnetic valves or other control devices, whose effects are based on magnetic forces, can, —for example, also consist of conducting graphite coils inserted in insulating graphite. It is also conceivable that the devices be formed from metal melts flowing in coil-shaped graphite channels. In this case, the channels can be implemented in the pipeline elements consisting of graphite.

In order to start the fusion drilling process according to the invention, it is advantageous if the fusion drilling procedure begins in a pre-bore, filled with inert gas, which is lined with a metal pipe anchored at the surface, particularly in a reinforced concrete cover. This steel-lined pre-bore should have a depth of approximately 30 to 50 meters, with at least the bottom meter remaining free from the metal piping.

Furthermore, it is necessary to provide power units, a metal melting facility with filling machines, and a device for attachment of the individual pipeline elements to one another at the boring surface. Further devices, such as oversized boring towers or hydraulic pressure and lifting facilities, are not necessary for the boring process according to the invention.

Care should be taken that the reinforced concrete cover is designed appropriately thickly and surrounds a large area around the borehole, so that the melt is prevented from breaking through to the surface during the start of the metal melt boring process and during the beginning of the compression of the rock melt, and possibly parts of the metal melt, into the surrounding rock.

Because cracks are typically already present in the rock, a pressure of only a few multiples of 10 bar is necessary to further widen the cracks which are present and to allow compression. This means that the depth of approximately 30 to 50 meters mentioned for a conventional pre-bore is sufficient to start the metal melt process according to the invention.

At the beginning of the boring, the first pipeline element is sunk into the metal-lined pre-bore, which is done by means of a manipulator device and/or with the aid of guide/support magnets located in the elements. After appropriate assembly of several pipeline elements, which advance up to just before the base of the borehole, the metal melt is poured into the inside of the pipeline until the metal melt rises, between the pipeline elements inserted into the borehole and the inner wall of the conventional pre-bore, up to the edge of the metal pipe lining. There, it bonds with the pipe through welding. The diameter of the graphite pipeline is hereby to be dimensioned in such a way that the outer side of the pipeline element and the inner side of the metal pipe lie tightly against one another in their heated condition, in order to prevent the fluid metal melt from penetrating.

In this way, a pressure seal is formed, so that the fusion drilling process can be started. In addition, the current loop for supplementary heating of the metal melt is closed through the connection between the metal melt strand and/or the graphite pipeline and the metal pipe inserted in the pre-bore.

To optimize the removal of rock from the base of the borehole, it is advantageous if the lowermost pipeline element, which acts as a boring head, has at least one magnetic pump/nozzle arrangement, by means of which the metal melt can be shot onto the base of the borehole in the form of at least one melt stream.

Through the further induction coils provided, which can be formed by the flowing metal melt itself (appropriate coil-shaped flow channels in the boring head), it is possible to overheat the melt stream in such a way that a stream at an extraordinarily high temperature of several thousand degrees or a plasma stream results, with which extraordinary boring progress can be achieved.

This overheated melt and/or plasma stream generates a local overheating as it penetrates into the melt, particularly in the central region, so that the rock removal is optimized there.

Through the implementation of at least one melt stream, which can preferably be directed by means of a magnetic coil arrangement provided in the lowermost pipeline element, the possibility also exists of counteracting uneven rock removal at the base of the borehole, which can result due to the different types of rock or anisotropy in the rock. For this purpose, the melt stream is directed onto the points in the base of the borehole where the removal is slowest.

One can make an image of the irregular removal of rock in the base of the borehole by sending electrical impulses via, for example, the melt column and/or the graphite pipeline down to the base of the borehole and measuring the run time of the impulses reflected from there. A topographical image of the base of the borehole can be produced and evaluated via the surface of the melt column/graphite pipeline and the runtime of the impulses, and control of the melt stream can be achieved.

Depending on the alignment of the melt stream, increased rock removal advantageously occurs in the region around the stream, so that the base of the borehole becomes cone-shaped in the direction of the stream, whereby the overall working surface for the hot metallic melt is increased and a larger overall removal rate can be realized.

The magnetic arrangements mentioned here can be controlled through control lines integrated in the pipeline elements, with the other notable advantage being that the magnetic arrangements operate without wear.

In order to ensure free movability of the metal melt stream below the magnetic coil arrangement integrated in the lowermost pipeline element (boring head), it is practical to implement a funnel-shaped recess in the boring head, particularly a centrally located one, within which the melt stream can be pivoted up to, for example, 60 degrees in all directions relative to the metal melt column.

The boring process can also be advantageously optimized by setting the melt over the base of the borehole in rotation, so that the rock melt, which is lighter than the metal melt, is conveyed upward and, due to centrifugal force, outward, and pressed into the cracks.

The rotation of the melt can hereby be effected through the magnetic arrangement, which also deflects the melt streams. The rotational axis of the melt is hereby given by the melt stream, so that the rotational axis of the melt is also adjustable.

It is advantageous if control elements, which cause a rotation of the melts and/or an alignment of the streams, are provided at least in the lowermost pipeline element, distributed over the entire length of the element, but preferably in several of the lower pipeline elements, acting on the melt in an identical way. In this case, burning away of the pipeline elements is not harmful and does not affect the control of the melt (streams).

Thus, for example, for the placement of a 10 km deep boring, a lower region of identical pipeline elements of a length of over 100 meters can be used, so that even if large amounts are burned away at the end of the deep boring, the boring head still forms a controllable pipeline element.

As a simple embodiment, the control elements can be at least three current conductors in contact with the melt, which are inserted in the pipeline elements. Through control of these conductors with polyphase current, rotation of the melts can be achieved. Through different current strengths on the phases, the rotational axis of the rotating melts can be pivoted, particularly around up to approximately 60°.

It is also possible to form the control elements through graphite coils or melts flowing in channels, as mentioned earlier.

Parts of the metal melt which are also compressed can be reclaimed because these parts of the melt can also be heated by the current flow, whereby the portions of melt remain fluid and again sink in the direction of the base of the borehole due to gravity.

Reclamation of the parts of the metal melt from the cracks in the rock is additionally promoted in that an attractive force can be exercised on the compressed parts of the metal melt through the magnets located in the pipeline elements.

The implementation of a pure metal lining of the borehole is thereby promoted due to the influence of the magnetic attractive forces.

Through the influence of these attractive forces it is also possible to purposely produce a borehole without a lining.

For this purpose, the magnetic devices producing the attractive force are switched off during the boring process, so that the lighter rock melt always floats on the metal melt and solidifies without being pushed away by the attractive force.

Correspondingly, a lining made of pure rock is implemented in this way.

BRIEF DESCRIPTION OF THE DRAWING

The sole FIGURE of the drawing is a cross sectional view of a schematic exemplary embodiment of the invention.

SPECIFIC DESCRIPTION

A pre-bore with the placement and anchoring underground of a thick-walled metal pipe 3 made of, for example, steel secures the start of the metal melt boring process without additional cooling.

A pipeline 1 made of several pipeline elements 9, which completely consist of graphite, is first assembled element by element from the individual pipeline elements via a hydraulic automatic manipulator, with the boring head element 18 first.

(For reasons of viewability, surface devices such as the manipulator, the metal melting facility with filling device, and power units with power connections are not depicted in the schematic drawing).

As soon as the graphite pipeline 1 slides, with its elements 9, into the metal pipe 3 of the pre-bore filled with inert gas, the guiding and support magnets 8 take over the further propulsion of the graphite pipeline 1. When the end of the pre-bore lining 3 is reached and the boring head element 18 lies a handsbreadth from the base of the borehole, the metal melt boring process can begin pouring in, for example, an iron melt and can continuously proceed up to the boring target, while the iron melt 10 can be supplied discontinuously due to the melt reservoir in the metal melt strand 2, so that in the meantime the lengthening of the graphite pipeline 1 can be performed element by element by the manipulator at the surface.

Through activation of at least one magnetic pump 4 and one magnetic nozzle 5, a defined amount of the already overheated iron melt of the metal melt strand 2 is compressed, further overheated, and pressed at high pressure through the magnetic nozzle 5 by magnetic force, and shot as a melt or plasma stream onto the base of the borehole 19, with, due to the rapid sequence of the process, a pulsed stream 17 arising, whereby the melting and removal effect is strengthened even more.

In order to ensure uniform removal at the base of the borehole, the iron melt stream is rotated by at least three rotary magnets 6 like a cone 14 in the function of a "fluid roller bit" around the axis of the melt stream 15, with the cone able to be pivoted through magnetic force within an angle of approximately 60 degrees in all directions 16. Because the melt stream automatically follows every pivot, uniform removal of the rock in front of the boring head element 18 of the graphite pipeline 1 is ensured.

The control of the metal melt cone 14 is performed from the surface via control lines provided in the pipeline elements.

The iron melt and the rock melt released fill the available space around the boring head element 18 of the graphite pipeline 1 while the pressure in the melt increases. A part of the iron melt is concentrated by the support magnets 8 around the graphite pipeline 1 above the boring head element 18 in a desired thickness, such as, for example, that of the metal pipe of the pre-bore, and formed into a uniform cast-iron lining 11 in the continuously progressing fusion drilling process.

Conditioned by the density of the iron melts, the lighter rock melts rise upward and are pressed into the surrounding rock at 12 due to the rock splitting under the pressure of the pumped-in melts and/or under the pressure of the graphite pipeline 1 as it moves forward. Iron melt which is also pressed in is subject to heating by means of current flow and, due to gravity, flows back into the lower-lying melt zone around the melt cone 14 as the graphite pipeline 1 moves forward.

The speed of progression of boring increases as the temperature and the relative pressure in the melt stream increase relative to the surrounding melt and its pulsed sequence (suction effect), as well as with the rotational speed of the melt stream and/or the rotational speed of the rotating melt.

As the boring depth increases, the intrinsic weight of the graphite pipeline 1, including the metal melt strand, also increases, until its weight and the pressure necessary for compression of the melt in the melt zone are in equilibrium and the graphite pipeline 1 glides as if on a melt cushion.

The magnetic valves 7 installed in each graphite pipeline element, which each support a part of the metal melt strand, work to maintain this condition, so that the increasing weight of the metal melt strand is distributed onto many support points as the depth increases. The same applies for the support magnets (8) in the outer region of the graphite pipeline.

If a sufficient weight has built up in the metal melt strand 2, this hydraulic pressure, in combination with the magnetic pump 4 and magnetic nozzle 5, can be used to form the melt stream 15 by simultaneously opening all the magnetic valves 7 and releasing a small, concrete amount of iron melt in a pulsed fashion. At 10,000 meters, the pressure of the iron melt column is already over 7000 bar if all magnetic valves 7 open simultaneously.

After pumping out the metal melt strand 2 and reaching the boring target, the graphite pipeline 1 is slid back out with the aid of the support and guide magnets 8 and the graphite pipeline is disassembled element by element. For this purpose, the borehole can be flooded with pressurized water for support.

What is claimed is:

1. A process for fusion drilling of a rock, comprising the steps of:

(a) advancing a pipeline element by element into a borehole in rock;

(b) feeding a molten metal as a boring medium through said pipeline to emerge from a lowest element of said pipeline, melt away the rock at a base of said borehole and produce a waste melt comprised of the molten metal and molten rock;

(c) cracking rock surrounding said borehole by effects of temperature and pressure of the feeding of the molten metal into said borehole;

(d) pressing said waste melt into cracked rock surrounding said borehole; and (e) forming a lining for said borehole from solidification of the waste melt around said borehole.

2. The process according to claim 1 wherein the metal melt coming out of the lowermost pipeline element over the base of the borehole is guided between the outer side of the pipeline element and the inner wall of the borehole and solidifies there.

3. The process according to claim 2 wherein the solidified melt forms a pressure seal.

4. The process according to claim 1 wherein the metal melt is heated by an electric current.

5. The process according to claim 4 wherein the electric current is passed through the melt in the pipeline and the solidified borehole lining.

6. The process according to claim 1 wherein a loss of metal melt occurring due to pressing solidification is compensated by the addition of melt at the beginning of the borehole.

7. The process according to claim 1 wherein the fusion drilling process begins in a pre-bore which is lined with a metal pipe anchored at a ground surface in a reinforced concrete cover.

8. The process according to claim 7 wherein the fusion drilling process is begun under an inert gas atmosphere.

9. The process according to claim 7 wherein the pipeline elements are lowered into the metal pipe down to shortly above the base of the borehole.

10. The process according to claim 9 wherein the lowering of the pipeline elements is performed by means of a manipulator device and with the aid of guide/support magnets located in the elements.

11. The process according to claim 10 wherein magnetic devices located in the pipeline elements are controlled for lifting of the pipeline elements.

12. The process according to claim 11 wherein to simplify lifting of the pipeline elements, the borehole is flooded with pressurized water.

13. The process according to claim 1 wherein the lowermost pipeline element has at least one magnetic pump/nozzle arrangement, by means of which the metal melt can be shot, in the form of at least one melt/plasma stream, onto the base of the borehole.

14. The process according to claim 13 wherein at least the lowermost pipeline element has at least one control arrangement, by which the melt/plasma stream can be aligned and by means of which the metal melt located over the base of the bore can be set in motion.

15. The process according to claim 1 wherein the melt stream is further heated by means of an induction coil arrangement and forms a plasma stream.

16. An apparatus for fusion drilling of a borehole in rock, comprising:

a pipeline comprised of a plurality of pipeline elements extendable element by element into a borehole in rock;

means for feeding a molten metal as a boring medium through said pipeline to emerge from a lowest element of said pipeline, to melt away the rock at a base of said borehole and to produce a waste melt comprised of the molten metal and molten rock, rock surrounding said borehole cracking by effects of temperature and pressure of the feeding of the molten metal into said borehole, said waste melt being pressed into cracked rock surrounding said borehole; and a lining for said borehole formed in situ from solidification of the waste melt around said borehole.

17. The apparatus according to claim 16 wherein surfaces of the pipeline elements in contact with the molten or solidified melt consist of a material resistant to high temperatures.

18. The apparatus according to claim 16 wherein the pipeline elements consist completely of a material resistant to high temperatures.

19. The apparatus according to claim 18 wherein the material has a low friction coefficient smaller than 0.5, and a low surface tension.

20. The apparatus according to claim 19 wherein the material is graphite or a metal composite ceramic.

21. The apparatus according to claim 18 wherein at least the lowermost pipeline element has at least one magnetic arrangement which forms a pump for conveyance of the melt and for producing at least one directable melt stream.

22. The apparatus according to claim 16 wherein each said pipeline element corresponds to a cylindrical piece with a central bore.

23. The apparatus according to claim 22 wherein the ratio of the external diameter to the internal diameter of the pipeline element is larger than 10:1.

24. The apparatus according to claim 16 wherein controllable magnetic devices, which are usable as support and guide magnets in combination with the metallic borehole lining, are located in the wall of a pipeline element.

25. The apparatus according to claim 16 wherein magnetic devices which are usable as valves for the melt to be guided are located in the wall of a pipeline element.

26. The apparatus according to claim 16, characterized in that the lowermost pipeline element forms a boring head and has a funnel-shaped recess.

27. The apparatus according to claim 16 wherein control elements are provided, at least in the lowermost pipeline element, through which the melt can be set in rotation, can be pivoted and can be directed.

28. The apparatus according to claim 27 wherein the control elements consist of at least three current conductors in contact with the melt.

29. A boring device for the production of fusion drilling borings of large-diameter in rock with which rock to be removed is meltable and by means of which a borehole lining made of solidified melt can be produced from the melt occurring in the melt process and fed into the borehole, wherein surfaces of the boring device in contact with the molten or solidified melt mass consist of graphite.

* * * * *